US006770855B2

(12) United States Patent
Howard et al.

(10) Patent No.: US 6,770,855 B2
(45) **Date of Patent: *Aug. 3, 2004**

(54) METHODS OF ASSEMBLING OPEN COIL ELECTRICAL RESISTANCE HEATERS INVOLVING BUTT WELDING OF RAILS AND USING WELDED INSULATOR SUPPORT CLIPS WITH BENDABLE TABS

(75) Inventors: Keith Howard, Cookeville, TN (US); Jimmy L. Sherrill, Cookeville, TN (US); Ike Walker, Monterey, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/404,138

(22) Filed: Apr. 2, 2003

(65) Prior Publication Data

US 2003/0192876 A1 Oct. 16, 2003

Related U.S. Application Data

(63) Continuation of application No. 09/949,374, filed on Sep. 6, 2001, now Pat. No. 6,596,974.

(60) Provisional application No. 60/234,236, filed on Sep. 21, 2000.

(51) Int. Cl.[7] ..... H05B 3/06

(52) U.S. Cl. ..... 219/536; 219/532

(58) Field of Search ..... 219/532, 536, 219/537, 465.1, 550, 357; 174/138 J; 338/280

(56) References Cited

U.S. PATENT DOCUMENTS

| | | | |
|---|---|---|---|
| 3,560,708 | A | 2/1971 | Fox |
| 3,697,727 | A | 10/1972 | Neuman et al. |
| 3,798,417 | A | 3/1974 | Bittner |
| 3,835,435 | A | 9/1974 | Seel |
| 3,846,619 | A | 11/1974 | Wightman et al. |
| 4,250,399 | A | 2/1981 | King |
| 4,322,606 | A | 3/1982 | Bayly |
| 4,628,189 | A | 12/1986 | Danko |
| 4,656,340 | A | 4/1987 | St. Louis |
| 4,994,654 | A | 2/1991 | St. Louis |
| 5,093,558 | A | 3/1992 | Blystone et al. |
| 5,124,534 | A | 6/1992 | Williams et al. |
| 5,578,232 | A | 11/1996 | Engelke |
| 5,880,440 | A | 3/1999 | Whitfield et al. |
| 5,935,471 | A | 8/1999 | St. Louis |
| 5,959,254 | A | 9/1999 | Martin, Sr. |
| 6,020,577 | A | 2/2000 | Barker |
| 6,509,554 | B2 | 1/2003 | Howard et al. |

*Primary Examiner*—Ehud Gartenberg
*Assistant Examiner*—Leonid M Fastovsky
(74) *Attorney, Agent, or Firm*—Clark & Brody

(57) ABSTRACT

A heater having a frame rail and clips, attached to the rail, for securing insulators for supporting a heater coil. Each clip has a main body having a structural member for securing to the rail, and having a pair of flanges symmetrical about a central axis. Each flange has a cut-out for supporting an insulator, the cut-out having an open end, a back abutment edge and a pair of side abutment edges. A bendable tab is located at either side of the open end, each having a first and a second position. In the first position an insulator is insertable into the cut-out, and the insulator is secured by bending the tabs to their second position. Optionally the main body has a cross-section that accommodates the cross section of the rail and the rail is welded to the channel. Alternatively, a plurality of clinching flaps extend from the main body, the flaps shaped and dimensioned for bending around and clinching the rail.

7 Claims, 2 Drawing Sheets

METHODS OF ASSEMBLING OPEN COIL ELECTRICAL RESISTANCE HEATERS INVOLVING BUTT WELDING OF RAILS AND USING WELDED INSULATOR SUPPORT CLIPS WITH BENDABLE TABS

This application is a CON of 09/949,374, filed Sep. 6, 2001 now U.S. Pat. No. 6,596,974.

Priority of this application is based on U.S. Provisional Application No. 60/234,236, filed on Sep. 21, 2000, which is hereby incorporated by reference.

Cross-reference is made to co-pending, commonly owned U.S. application Ser. No. 09/827,323, filed on Apr. 6, 2001.

FIELD OF THE INVENTION

The present invention relates to clips for supporting insulators in electric heaters. More particularly, this invention relates to a flat metal clip for supporting a flat ceramic insulator which has at least one closed or open hole for retaining an electrical resistance heating coil.

STATEMENT OF THE RELATED ART

The use of round bushing or barrel-shaped ceramic insulators to support electric resistance heating coils, which are "strung through" the bushings, is well known in the prior art. The use of flat ceramic insulators with either a closed hole or an open-ended hole at each end of the insulator to support electric resistance heating coils is also known in the art. Also known in the art are flat insulators with only one closed or open-ended hole, often referred to as "half insulators".

Bushing insulator supports require at least one bushing ceramic insulator at each support point for the resistance heating coil, and a metal support for holding each insulator. On the other hand, flat insulators with a closed or open-ended hole at each end can support an electric resistance heating coil at both ends of the insulator.

However, electric heaters which use flat ceramic insulators with a closed or open-ended hole to support the heating wire have two substantial problems. The first problem occurs when the insulator is at the end of the metal support structure, where the electric resistance coil passes through one hole in the insulator, then is reversed and passed through the hole in the opposite end of the insulator. In the existing designs of this type, the metal structure supporting the flat ceramic insulator may incur a risk of a short circuit due to insufficient clearance between the electric heating coil and the metal insulator support.

The second problem with existing flat, two-hole ceramic insulators is that the insulators and existing metal insulator supports cannot be made with a narrow profile, as is possible with electric heaters which use bushing insulators. In particular, the metal insulator supports have a width which is significantly greater than the width of the flat insulator.

SUMMARY OF THE INVENTION

An embodiment of the present invention is a substantially flat metal clip for supporting one or two insulators, particularly flat ceramic insulators having at least passage for supporting an electric resistance heating coil.

One example of this embodiment connects two insulators to a rail of an electric heater frame, and includes a insulator-support clip which comprises a main body having a center axis and structural member for securing to the rail. A first flange extends from the body perpendicular to the center axis. The first flange has a first cut-out for accommodating a first insulator. The first cut-out has an open end with a first width in the extending direction of the flange, an abutment edge spaced a first support depth from the open end, an inner edge proximal to the body and an outer edge spaced the first support width from the inner edge. A first pair of bendable tabs is attached to the first flange, each bendable from a respective first position to a respective second position, positioned at respective ends of the open end of the first cut-out. The first pair of bendable tabs, when each is in its first respective position, permits insertion of the first insulator into the first cut-out and, when each is bent to its respective second position, constrains the first insulator within the first cut-out.

A second flange, having a second cut-out to support a second insulator, and preferably formed identical to the first flange, extends from the body in a direction opposite from the first flange. The second flange has a second pair of bendable tabs disposed at respective ends end of the open end of the second cut-out. Like the first pair of bendable tabs, the second pair of bendable tabs, when each is in its first respective position, permits insertion of the second insulator into the second cut-out and, when each is bent to its respective second position, constrains the second insulator within the second cut-out.

In a first aspect of this embodiment the structural member for securing to the rail is a channel extending along the central axis, having a cross-section that accommodates the cross of the rail, whereby the rail is welded to the channel.

In a second aspect of this embodiment the structural member for securing to the rail is a pair of T-shaped structures, each aligned on the central axis, each having a pair of bendable flaps extending outward from the central axis, the bendable flaps shaped and dimensioned for bending around and clinching the rail.

One feature of this second aspect is the pair of bendable flaps being formed to bend around and clinch a rail having a T-shaped cross section.

A further embodiment of this invention is in substantial accordance with either of the first and second aspects, but having only one flange, for supporting a single insulator.

A further aspect of the present invention is a clip/insulator assembly including any of the above-summarized aspects or embodiments of the inventive clip, supporting either one or two flat ceramic insulators, each insulator having at least one passage for supporting an electric resistance heating coil.

Another aspect of the present invention is a clip/insulator/rail assembly including any of the above-summarized aspects or embodiments of the inventive clip, supporting either one or two flat ceramic insulators, each insulator having at least one passage for supporting an electric resistance heating coil, the clip being secured to a frame rail of an electric heater.

A still further aspect of the present invention is an electric heater comprising the clip/insulator/rail assemblies of this invention.

Another aspect of this invention is that the insulators for securing within the inventive clip may be formed as half insulators, which have as few as one passage for supporting a heater coil. Still further, the inventive insulators for secure mounting with the inventive clips may be formed with either open or closed passages for supporting the heating coils.

The unique metal clips of this invention, used in conjunction with the aforementioned types of flat insulators, eliminates the need for ceramic bushing or barrel-shaped insulators.

Therefore, a primary object of this invention is to provide an insulator-support clip which has a low profile structure that eliminates interference between the heater coils and the metal frame in an electric heater.

A further object of this invention is to provide an insulator-support clip which permits replacement of round, bushing or barrel-type insulators with flat open or closed-ended ceramic insulators.

Another object of this invention is to provide an insulator-support clip which can be used with a variety of metal frames in electric heaters.

A still further object of this invention is to provide an insulator-support clip which facilitates automated assembly of the electric heaters when clamped to unique metal T-bar support rails.

Numerous other features, objects and advantages of the invention will become apparent from the following description when read in conjunction with the accompanying drawings, in which:

DETAILED DESCRIPTION OF THE INVENTION

Figure 1:
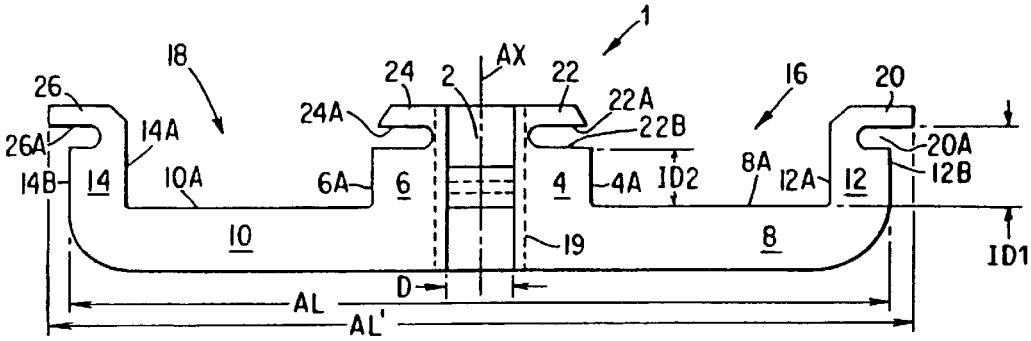
FIG. 1 is a top view of an example embodiment of a welded mount double clip according to the present invention.

FIG. 1 depicts a top view of a first embodiment of a double clip, labeled by reference numeral 1, in accordance with the present invention. The example double clip 1 has a semi-cylindrical channel 2, having a diameter D and a depth D/2 in a direction into the surface of the drawing, the channel extending along an axis AX. The function of the channel 2, as described in greater detail below, is to accommodate a frame rail to which the clip 1 is welded. The FIG. 1 example is for a round frame rail and, therefore, the channel 2 is a semi-cylinder. Other shapes of the channel 2 can be used for other cross-sectional shapes of frame rails.

Extending from one side of the channel 2, in a first direction perpendicular to AX, is a first inward flange 4. Extending from the other side of the channel 2, in a direction opposite the first direction, is a second inward flange 6. The first and second inward flanges of the depicted example preferably lie in a common plane, such as the plane labeled "P" in FIGS. 8 and 9 described further below. A first support flange 8 extends in the first direction from the first inward flange 4 and, likewise, a second support flange 10 extends, in a direction opposite the first direction, from the second inward flange 6. At a distal end of the first support flange 8 a first outer tab flange 12 extends in the AX direction and, similarly, at a distal end of the second support flange 10 a second outer tab flange 14, preferably identical in form to the first outer support flange 12, extends in the AX direction. The dimension from the outer edge 12A of the first outer tab support flange to the outer edge 14A of the second outer tab support flange is labeled AL.

The exposed outer edge 4A of the first inner flange 4, the edge 8A of the first support flange 8 extending in the first direction and intersecting 4A, and the inner edge 12A of the first outer tab support 12 define a first cut-out 16. Similarly, the exposed outer edge 6A of the second inner flange 6, the edge 10A of the second support flange 10 extending opposite the first direction and intersecting 6A, and the inner edge 14A of the second outer tab support 14 define a second cut-out 18.

Figure 8:
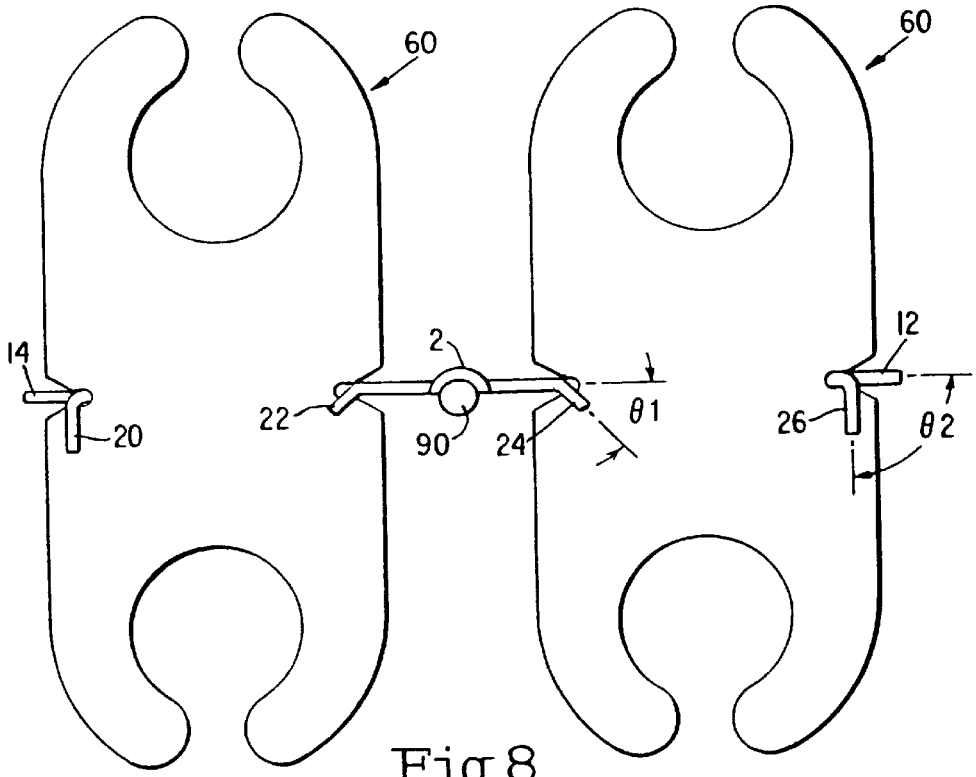
FIG. 8 is a front view of an example rail/clip/insulator assembly of this invention, having the clip shown in FIG. 1 securing an insulator as shown in FIG. 4 and welded to a frame rail.
Figure 9:
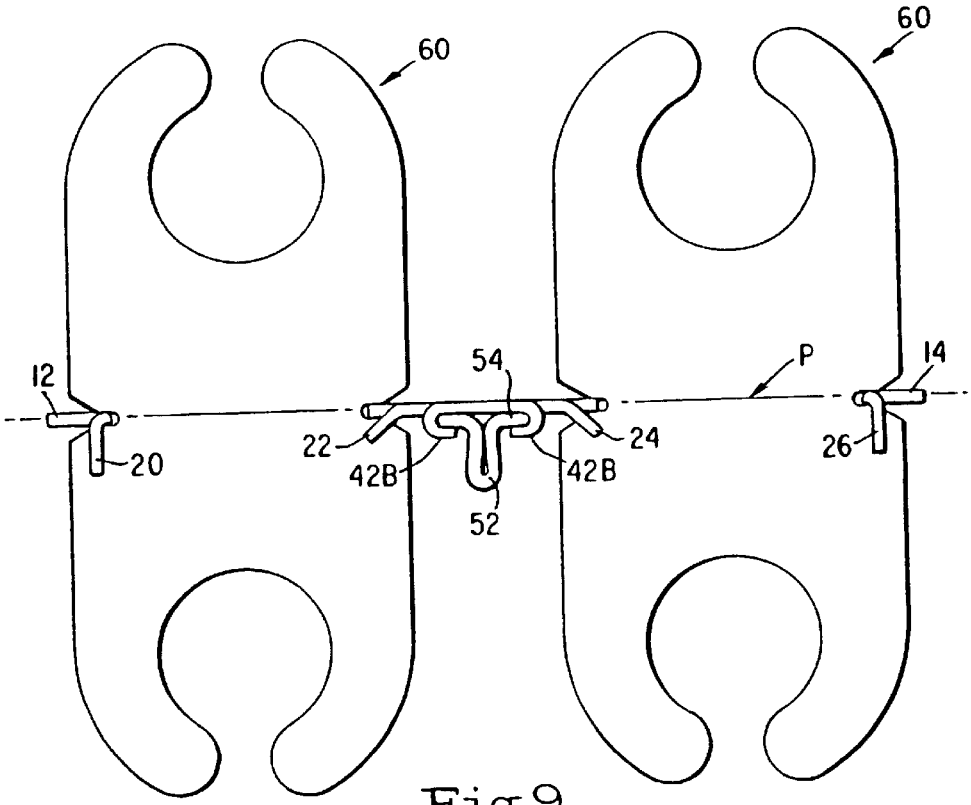
FIG. 9 is a front view of an example rail/clip/insulator assembly of this invention having the clip shown in FIG. 2 securing an insulator as shown in FIG. 4 and clinched to a T-bar frame rail.

Referring to FIG. 1, a first outer tab 20 is attached proximal to the inner edge 12A of the first outer tab support 12. The first outer tab 20 has an abutment face 20A extending perpendicular to the axis AX and spaced ID1 from the abutment face 8A of the first cut-out 16. Similarly, a first inner tab 22 is attached to the first inner flange 4, and has an abutment face 22A extending perpendicular to the axis AX, also spaced ID1 from the abutment face 8A of the first cut-out 16. As shown in FIG. 1, the abutment faces 20A and 22A are aligned along the AX axis. The distance ID1 is preferably slightly greater than the thickness TK of the first insulator 60 (or 60') described in reference to FIGS. 5 and 6 below. The first outer tab 20 is spaced from the first outer tab support 12 by a notch (not numbered) defined on one side by the abutment edge 20A of the first outer tab and by the facing edge labeled 20B. Similarly, the first inner tab 22 is spaced from the first outer tab support 12 by a notch (not numbered) defined on one side by the abutment edge 22A of the first inner tab and by the facing edge labeled 22B. Preferably, the edge labeled 20B is aligned with the edge labeled 22B, each being spaced a distance ID2 from the abutment face 8A of the first cut-out 16. The distance ID2 is preferably less than the thickness TK of the first insulator 60 or 60'. As will be understood from the description below, the dimensions ID1 and ID2 are respectively set greater than, and less than, the thickness TK of the insulator 60 to permit the tabs 20 and 22 to be bent as shown in FIGS. 8 and 9 after the first insulator 60 is inserted into the first cut-out 16.

Referring to FIG. 1, similar to, and preferably identical to the above-described first inner tab and first outer tab 22 and 20, respectively, a second inner tab 24 is attached to the inner edge 6A of the second inner flange 6 and a second outer tab 26 is attached to the inner edge 14A of the second outer tab support 14. Like tabs 20 and 22, the second inner tab 24 has an abutment face 24A extending perpendicular to the axis AX, preferably spaced ID1 from the abutment face 10A of the second cut-out 18. A second outer tab 26 is likewise attached to the second outer tab support flange 14, proximal to its inner edge 14A. The second outer tab 26 has an abutment face 26A extending perpendicular to the axis AX, also preferably spaced ID1 from the abutment face 10A of the second cut-out 18.

A further unique feature of the example clip 1 of this invention is the direction of the first and second inner tabs 22 and 24 vis-á-vis the first and second outer tabs 20 and 26. Specifically, as shown in FIG. 1, first outer tab 20 is initially formed in the same direction along AL as the first inner tab 22. Likewise, the second outer tab 26 is initially formed in the same direction, also along AL, as the second inner tab 24. The clip 1 example uni-directional configuration of its first inner and outer tabs, and its second inner and outer tabs, produces an overall clip dimension AL, from one outer edge 12A to the opposite outer edge 14A, which is smaller than the overall dimension AL' prior to bending the outer tabs 20 and 26 to retain the insulator in the clip 1. The dimension AL is also smaller than would be possible in the prior-art.

As mentioned previously, in existing clip designs two retaining tabs are formed in opposition to each other at a 180° angle to each other, or such that the retaining tabs are outward-facing and must be twisted to retain the insulator. In these prior designs, metal must extend beyond the length of the insulator more than the clip in the present invention. This lessens the clearance between the insulator-support clip and the resistance wire, and thus increases the risk of a short circuit. The unique shape of the depicted example clip 1 of this invention, however, allows for a low profile electric heater, which avoids the problem of inadequate clearance between the heating element coils and the insulator-support clip existing in prior art heaters using a flat insulator with two holes for retaining the heating coil.

Clip 1 is adapted for attachment to a rail of an electric heater frame. In FIG. 1, the position of a rail relative to the main body 2 of the clip is indicated by the dotted lines designated by reference numeral 19. Preferably, clip 1 is attached to a rail by welding the channel 2 to the rail. Alternatively, the main body of clip 1 can be attached to a rail by other suitable means, e.g., rivets, screws and the like. Rails suitable for attachment to the clip 1 having a channel such as 2 include those having round cross-sections or other conventionally shaped cross-sections.

Figure 2:
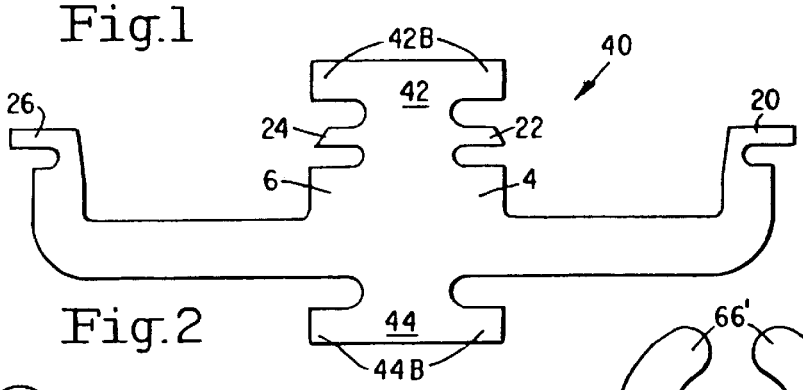
FIG. 2 is a top view of an example embodiment of a clinch mount double clip according to the present invention.

FIG. 2 is a top view of a second embodiment of a two-insulator clip of this invention, which is designated in general by reference numeral 40. Clip 40 is identical to the example clip 1 of FIG. 1, with the exception of substituting in place of the semi-cylindrical (or other shaped) channel 2 (for welding or equivalent attachment to a frame rail), a bendable structure for crimping or clinching to a frame rail. Referring to FIG. 2, the example bendable clinch structure includes a first and second T-shaped structure, labeled 42 and 44. The specific form of the bendable clinch structures 42 and 44 is dictated in part by the cross-sectional form of the frame rail which the structures will clinch. The T-shaped form of the bendable clinch structures 42 and 44 shown in FIG. 2 is preferably used for attachment to a rail with a T-shaped cross section, such as the example shown in FIG. 3.

Figure 3:
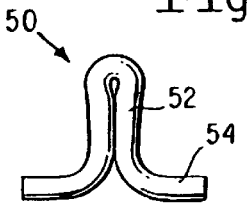
FIG. 3 is a front view of a T-bar heater frame rail for use with a clip in accordance with FIG. 2.

FIG. 3 illustrates a cross-section of an example T-shaped rail 50 which can be used in conjunction with clip 40. Rail 50 comprises a stem section 52 and a ridge section 54. When clip 40 is attached to rail 50, clinching flaps 42B and 44B are crimped or clinched around ridge section 54, as shown in FIG. 4.

The "T" shape of the example rail 50 is preferable for many applications as it has a high strength-to-weight ratio with respect to lateral forces and, therefore, will not deflect as a result of heating and cooling or normal mechanical forces, unlike conventional rails used in electric heater frames. The T-shaped rail is made separately from narrow, flat pieces of metal without cross-beams or clips, which are subsequently attached. Consequently, there is typically little scrap material in the making of a T-shaped rail.

Figure 4:
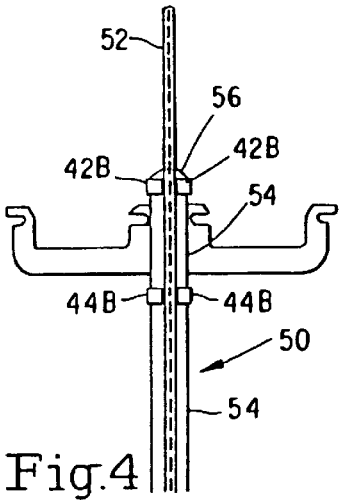
FIG. 4 is bottom view of a clip according to FIG. 2 clinched to a T-bar frame rail as shown in FIG. 3.

FIG. 4 shows a bottom view of an example of the clip 40 crimped or clinched around the FIG. 3 rail 50 to secure the clip to the rail. As shown in FIG. 4, a particular feature of T-shaped rail 50 is that its ridge section 54 is preferably trimmed off on the section of the rail just beyond the clinching flaps 42B and 44B, creating a flat surface 56. The flat surface 56 offers two advantages. First, it provides a convenient surface for welding cross-beams to multiple T-shaped rails (not shown) in a frame to hold the rails together. Second, in an electric heater (not shown), the flat surface 56 will be positioned underneath the unsupported looped end turns of a heater coil (not shown). The looped end turns are the most likely portion of the coil to sag. Thus, the presence of the flat surface 46 in the T-shaped rail creates maximum clearance between the rail, which is a conductor, and the least unsupported portion of the heater coil.

Figure 5:
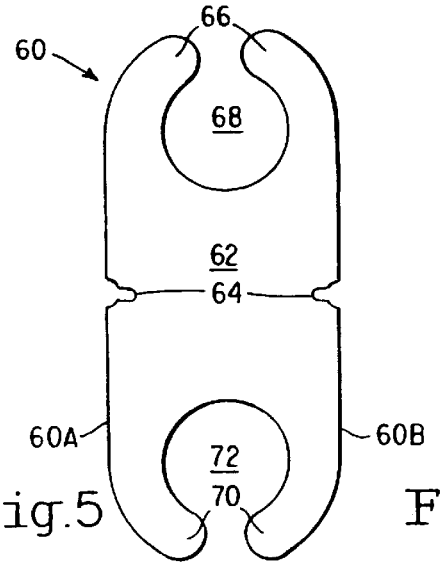
FIG. 5 is a front view of an example insulator of this invention, for securing within the clip of FIGS. 1 and 2.
Figure 6:
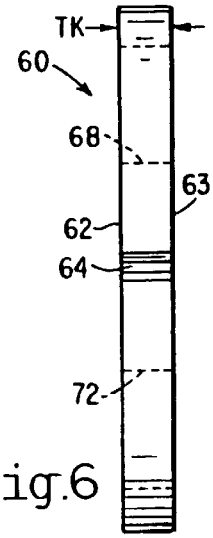
FIG. 6 is a side view of the FIG. 5 example insulator, seen from view line 5—5.

FIGS. 5 and 6 illustrate a front view and a side view, from view line 5—5, respectively, of an example insulator 60 according to this invention, for securing within either the example inventive clip 1 or clip 40. The example insulator 60 has a front flat surface 62 and an identical parallel back flat surface 63. The thickness TK, measured from the front surface 62 to the back surface 63, preferably has a value between the ID1 and ID2 dimension shown in FIG. 1. The insulator 60 contains two central notches 64 formed in central portions of its opposite first and second longitudinal sides 60A and 60B. As will be described below, two of the example insulators 60 can be gripped by the clip 1 or 40. One of the two notches is gripped by the first inner bendable tab and the other is gripped by the first outer bendable, which are items 21 and 26.

As shown in FIG. 5, insulator 60 can be formed with a first pronged structure 66 forming a first partially enclosed heater coil support passage 68, and with a second pronged structure 70 forming a second partially enclosed heater coil support passage 72. Alternatively, instead of the pronged structures 66 and 70, and open-ended passages 68 and 72, semi-circular or equivalent structures may define closed heater coil support passages (not shown).

The insulators used in conjunction with the clips of the present invention are preferably made of a ceramic-like material, e.g., steatite, so as to electrically insulate the heater coil from the heater frame and thermally insulate the heater coil to prevent undue conduction of heat away from the portions of the coil in contact with the insulator.

Figure 7:
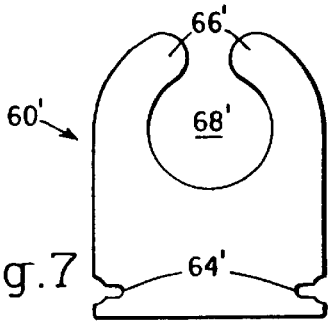
FIG. 7 is a front view of another example insulator of this invention, for securing within the clip of FIGS. 1 and 2, or within a clip having one-half of those shown in FIGS. 1 and 2

FIG. 7 illustrates a front view of an example half-insulator 60', which is an alternative to the FIG. 5 insulator. The FIG. 7 half-insulator has the same structure as one-half of insulator 60, with the structures labeled 64', 66' and 68' corresponding to one of those labeled 64, 66 and 68, respectively. As will be understood, the half-insulator 60' is for supporting a heater coil (not shown) without a loop-back (not shown) through another passage of the same insulator.

FIG. 8 illustrates a front view of an example clip/insulator/rail assembly (and clip/insulator assembly) according to the present invention, comprising the example clip 1 welded to a rail 90. As shown in FIG. 8, a first insulator 60 is attached to the clip 1 by placing the insulator into the first cut-out 16 of FIG. 1 such that the front surface 60A of the insulator is against the edge 8A, the first inner bendable tab 22 passes through one of the notches 64, and the first outer bendable tab 20 passes through the other of the notches 64. After the insulator 60 has been placed as described into the first cut-out 16, the tabs 20 and 22 are bent out of the major plane P of the clip. The bending angle for the tabs 20 and 22, labeled THETA1 and THETA2, respectively, are driven in part by the shape and dimension of the notches 64, and their position with respect to the tabs. In the example depicted in FIG. 8, the preferable angle THETA2 for the outer bendable tabs 20 and 26 is approximately 90 degrees, while the preferable angle THETA1 of the inner bendable tabs 22 and 24 is approximately 45 degrees. After the tabs 20 and 22 are bent as shown, the first insulator 60 is secured within the first cut-out 16, as can be seen in FIG. 8. Likewise, the second insulator 60 is inserted into the clip 1, whereupon the second inner bendable tab 24 and the second outer bendable tab 26 are bent as shown in FIG. 8.

FIG. 9 shows another embodiment of a clip/insulator/rail assembly according to this invention, which is identical to the assembly described above in reference to FIG. 8 except that a clip 40, as shown in FIG. 2, which is clinched to a T-rail 50 supports the insulators.

The present invention is further directed to electric heaters using the clips of this invention to secure insulators to rails of the electric heater frame. Although the description below is directed to open-coil electric heaters, the clips of this invention can be used in any heater which uses insulators to support heating coils and which use clips to support the insulators in a spaced relationship to a rail of the heater.

Broadly, an electric heater according to this invention will include a terminal plate (not shown), a top cross-beam (not shown), a plurality of rails (not shown) attached at one end to the terminal plate and at the other end to the cross-beam, one or two heating coil elements 9 not shown) disposed on opposite sides of the rails, a plurality of insulator-support clips, such as items 1 or 40, attached to each the rails, and one or two insulators such as items 60 or 60' attached to each clip.

In one embodiment of the heater of this invention, the heater will use a plurality of clips corresponding to clip 1 to secure insulators preferably corresponding to insulators 60, to rails having a round or other conventionally shaped cross-section. The clips may be attached to the rails by welding as shown in FIG. 7. In another embodiment, the heater uses a plurality of clips such as the FIG. 2 example clip 40 to secure insulators, such as insulators 60, to rails having a T-shaped cross-section, such as, e.g., rail 50 shown in FIGS. 3 and 4. In this latter embodiment, as discussed previously herein, the clips are attached to the rails 50 by clinching the clinching flaps 42B and 44B around the ridge 54 of the rail.

Preferably, the heating coil elements used in the heaters of this invention will be a continuous length of suitable electrical resistance heating wire, such as Nichrome or the like. Preferably, the heating elements are in the form of longitudinal helical coils of the electrical resistance heating wire with the coils each having a multiplicity of generally uniformly spaced convolutions.

The heating coil element(s) used in the heaters of this invention will typically each have a plurality of adjacent heating element runs, wherein each of the adjacent runs of the heating element(s) are electrically connected in series to an adjacent run of the heating element by a looped end turn. In addition, the heating element(s) will typically have leads which constitute the ends of the heating element(s) and which are electrically connected to electric terminals (not shown) in the terminal plate.

The heating element runs will be supported by insulator 60 and/or insulator 60' by placing a coil section of a run (not shown) within one of the open-ended passages 68 and 72 (or, alternatively, a closed hole). The insulator(s) 60 in turn is supported by clip 1 as described previously.

One end of each rail used in the heaters of this invention is preferably butt-welded directly to the terminal plate. In the prior art, frame rails were bent or otherwise shaped to increase the surface area to be welded onto the terminal plate. Butt-welding decreases the amount of terminal plate surface area taken up by welding the frame bars to the terminal plate, and allows for automation.

Welding of frame rails to a terminal plate is frequently difficult in the heating element industry because the metal in frames is typically coated with anti-corrosion materials. The coating, with its oxide layer, must be blown away by the welding process before a secure joint can be formed. In the prior art, both the frame and the terminal plate were corrosion-protected, causing welding to be difficult and hard to control. In the present invention, the end of each frame rail is severed, providing a fresh, uncoated surface that can be welded onto the terminal plate. Consequently, the welding process is simpler, as only one barrier, namely the coating on the terminal plate, has to be overcome to create a secure weld. In addition, the frame rails can be shorter with butt-welding, saving metal and labor, because special end shapes are eliminated.

It should be understood that the particular embodiments shown in the drawings and described within this specification are for purposes of example and should not be construed to limit the invention which will be described in the claims below.

What is claimed is:

1. In a method of assembling an open coil electrical resistance wire heater having a terminal plate with a plurality of rails extending therefrom, a cross beam connecting the rails, at least one heater coil element disposed on one side of the rails, and insulator support clips mounted to the rails and supporting the at least one heater coil, the improvement comprising butt welding an end of each rail to the terminal plate.

2. The method of claim 1, wherein the rail has a t-shape.

3. The method of claim 1, wherein the rail has a round or other conventional cross section.

4. The method of claim 1, wherein the rail has a first portion that is t-shaped and a second portion that is generally rectangular in cross section, the t-shaped portion being butt welded to the terminal plate and the second portion being aligned with the cross beam for attachment purposes and to increase spacing between a bend in the at least one heater coil and an adjacent rail facing the bend.

5. In a method of assembling an open coil electrical resistance wire heater having a terminal plate with a plurality of rails extending therefrom, a cross beam connecting the rails, at least one heater coil element disposed on one side of the rails, and insulator support clips mounted to the rails and supporting the at least one heater coil, the improvement comprising:

a) providing a number of metal clips, each metal clip comprising:

i) a body with a center channel extending parallel to a first direction;

ii) a first flange extending from the body in a direction perpendicular to the first direction and having a cutout to receive a respective insulator support clip; and iii) a pair of bendable tabs, each bendable tab disposed on the first flange so that bending of the pair of tabs retains one of the insulators in the cutout; and b) welding each channel of each metal clip to the rail.

6. The method of claim 5, wherein each metal clip has a pair of flanges to receive a pair of insulator supports.

7. The method of claim 5, wherein the rail has a round or other conventional cross section.

* * * * *